US009712937B2

(12) United States Patent
Kitazawa

(10) Patent No.: US 9,712,937 B2
(45) Date of Patent: Jul. 18, 2017

(54) SOUND SOURCE SEPARATION APPARATUS AND SOUND SOURCE SEPARATION METHOD

(71) Applicant: CANON KABUSHIKI KAISHA, Tokyo (JP)

(72) Inventor: Kyohei Kitazawa, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 100 days.

(21) Appl. No.: 14/716,260

(22) Filed: May 19, 2015

(65) Prior Publication Data

US 2015/0341735 A1 Nov. 26, 2015

(30) Foreign Application Priority Data

May 26, 2014 (JP) ..... 2014-108442

(51) Int. Cl.
*H04R 5/00* (2006.01)
*H04S 5/00* (2006.01)
(Continued)

(52) U.S. Cl.
CPC ..... *H04S 5/00* (2013.01); *G10L 2021/02166* (2013.01); *H04R 3/00* (2013.01);
(Continued)

(58) Field of Classification Search
CPC ..... H04M 9/082; H04M 9/08; H04M 3/002; H04M 3/568; H04M 1/72591; H04R 3/02; H04R 3/002; H04R 3/005; H04R 2499/11; H04R 2499/13; H04R 2499/15; H04R 2430/03; H04R 1/1083; H04R 1/1091; H04R 1/406; H04R 1/08; H04B 3/23; H04B 3/20; H04B 3/234; H04B 3/235;
(Continued)

(56) References Cited

U.S. PATENT DOCUMENTS

2011/0014981 A1* 1/2011 Mao ..... H04R 3/005 463/36
2012/0045066 A1* 2/2012 Nakadai ..... G10L 21/028 381/20

OTHER PUBLICATIONS

Duong, et al., "Under-Determined Reverberant Audio Source Separation Using a Full-rank Spatial Covariance Model", IEEE Transactions on Audio, Speech and Language Processing, vol. 18, No. 7, pp. 1830-1840, Sep. 2010.

* cited by examiner

*Primary Examiner* — Leshui Zhang
(74) *Attorney, Agent, or Firm* — Carter, DeLuca, Farrell & Schmidt, LLP

(57) ABSTRACT

An apparatus of this invention stably separates a sound source even when the relative positional relationship between the sound source and a sound pickup device has changed. This apparatus includes a sound pickup unit configured to pick up sound signals of a plurality of channels, a detector configured to detect a change in a relative positional relationship between a sound source and the sound pickup unit, a phase regulator configured to regulate a phase of the sound signal in accordance with the relative position change amount detected by the detector, a parameter estimator configured to estimate a variance and spatial correlation matrix of a sound source signal as sound source separation parameters with respect to the phase-regulated sound signal, and a sound source separator configured to generate a separation filter from the estimated parameters, and perform sound source separation.

13 Claims, 8 Drawing Sheets

(51) Int. Cl.
*H04R 3/00* (2006.01)
*G10L 21/0216* (2013.01)

(52) U.S. Cl.
CPC ..... *H04S 2400/01* (2013.01); *H04S 2400/11* (2013.01); *H04S 2420/05* (2013.01)

(58) Field of Classification Search
CPC . G10L 2021/02082; G10L 2021/02166; G10L 2021/02165; G10L 21/0208; G10L 21/02; G10L 21/0216; G10L 21/0232; G10L 19/012; G10L 19/00; G10L 15/20; G10K 11/16; G10K 11/175; G10K 11/178; G10K 2210/505; G10K 2210/1081; G10K 11/002; G10K 11/346; H03G 5/165; H03G 9/025; H03F 2200/03; H04L 65/403; H04L 65/80
USPC ..... 381/17, 18, 19, 20, 21, 300, 301, 302, 381/303, 307, 119, 66, 27, 71.1–71.6, 381/71.9, 71.11, 71.12, 26, 318, 86, 92, 381/94.1, 93, 95, 96, 122, 123; 379/406.01–406.16, 157, 158, 201.01, 379/202.01, 93.21, 205.01; 455/569.1, 455/570, 416; 709/204; 700/94
See application file for complete search history.

SOUND SOURCE SEPARATION APPARATUS AND SOUND SOURCE SEPARATION METHOD

BACKGROUND OF THE INVENTION

Field of the Invention

The present invention relates to a sound source separation technique.

Description of the Related Art

Recently, moving image capturing can be performed not only by a video camera but also by a digital camera, and opportunities of picking up (recording) sounds at the same time are increasing. This poses the problem that a sound other than a target sound is mixed when picking up the target sound. Therefore, researches have been made to extract only a desired signal from a sound signal in which sounds from a plurality of sound sources are mixed. For example, a sound source separation technique performed by array signal processing using a plurality of microphone signals such as a beam former or independent component analysis (ICA) has extensively been studied.

Unfortunately, this sound source separation technique performed by the conventional array signal processing poses the problem (under-determined problem) that it is impossible to simultaneously separate sound sources larger in number than microphones. As a method which has solved this problem, a sound source separation method using a multi-channel Wiener filter is known. A literature disclosing this technique is as follows.

N. Q. K. Duong, E. Vincent, R. Gribonval, "Under-Determined Reverberant Audio Source Separation Using a Full-rank Spatial Covariance Model", IEEE transactions on Audio, Speech and Language Processing, vol. 18, No. 7, pp. 1830-1840, September 2010.

This literature will briefly be explained. Assume that M (≥2) microphones pick up sound source signals sj (j=1, 2, . . . , J) generated from J sound sources. To simplify the explanation, assume that the number of microphones is two. An observation signal X obtained by the two microphones can be written as follows:

$$X(t)=[x_1(t)x_2(t)]^T$$

where $[\ ]^T$ represents the transpose of a matrix, and t represents time.

Performing time-frequency conversion on this observation signal yields:

$$X(f,n)=[x_1(n,f)x_2(n,f)]^T$$

(f represents a frequency bin, and n represents the number of frames (n=1, 2, . . . , N)).

Letting hj(f) be the transmission characteristic from a sound source to a microphone, and cj(n,f) be a signal (to be referred to as a source image hereinafter) of each sound source observed by a microphone, the observation signal can be written as superposition of signals of the source sources as follows:

$$X(n,f)=\sum_j cj(n,f)=\sum_j sj(n,f)*hj(f) \tag{1}$$

It is assumed that the sound source position does not move during the sound pickup time, and the transfer characteristic hj(f) from a sound source to a microphone does not change with time.

Furthermore, letting Rcj(n,f) be the correlation matrix of a source image, vj(n,f) be the variance of each time-frequency bin of the sound source signal, and Rj(f) be a time-independent spatial correlation matrix of each sound source, assume that the following relationship holds:

$$Rcj(n,f)=vj(n,f)*Rj(f) \tag{2}$$

for $$Rcj(n,f)=cj(n,f)*cj(n,f)^H$$

where ( )H represents Helmitian transpose.

By using the above relationship, the probability at which the observation signal is obtained as superposition of all sound images is given, and parameter estimation is performed using an EM algorithm. In E-step:

$$Wj(n,f)=Rcj(n,f)\cdot Rx^{-1}(n,f) \tag{3}$$

$$\hat{c}j(n,f)=Wj(n,f)\cdot X(n,f) \tag{4}$$

$$\hat{R}cj(n,f)=\hat{c}j(n,f)*\hat{c}j^H(n,f)+(I-Wj(n,f))\cdot Rcj(n,f) \tag{5}$$

In M-step S:

$$vj(n,f)=\frac{1}{M}tr\left(Rj^{-1}(f)\cdot\hat{R}cj(n,f)\right) \tag{6}$$

$$Rj(f)=\frac{1}{N}\sum_{n=1}^{N}\frac{1}{vj(n,f)}\hat{R}cj(n,f) \tag{7}$$

$$Rx(n,f)=\sum_j vj(n,f)\cdot Rj(f) \tag{8}$$

By iteratively performing the above calculations, the parameters Rcj(n,f) (=vj(n,f)*Rj(f)) and Rx(n,f) for generating the multi-channel Wiener filter for performing sound source separation can be obtained. An estimated value of the source image cj(n,f) as the observation signal of each sound source is output by using the calculated parameter as follow:

$$cj(n,f)=Rcj(n,f)\cdot Rx(n,f)^{-1}X(n,f) \tag{9}$$

In the above-mentioned conventional method, it is assumed that the sound source position does not move during the sound pickup time, in order to stably obtain the spatial correlation matrix. This poses the problem that no stable sound source separation can be performed if, for example, the relative positions of a sound source and sound pickup device change (for example, when the sound source itself moves or the sound pickup device such as a microphone array rotates or moves).

SUMMARY OF THE INVENTION

The present invention has been made to solve the above-described problem, and provides a technique capable of stably performing sound source separation even when the relative positions of a sound source and sound pickup device change.

According to an aspect of the present invention, there is provided a sound source separation apparatus comprising: a sound pickup unit configured to pick up sound signals of a plurality of channels; a detector configured to detect a change in relative positional relationship between a sound source and the sound pickup unit; a phase regulator configured to regulate a phase of the sound signal in accordance with the relative position change amount detected by the detector; a parameter estimator configured to estimate a sound source separation parameter with respect to the phase-regulated sound signal; and a sound source separator configured to generate a separation filter from the parameter estimated by the parameter estimator, and perform sound source separation.

According to the present invention, sound source separation can stably be performed even when the relative positional relationship between a sound source and sound pickup device has changed.

Further features of the present invention will become apparent from the following description of exemplary embodiments (with reference to the attached drawings).

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Figure 1:
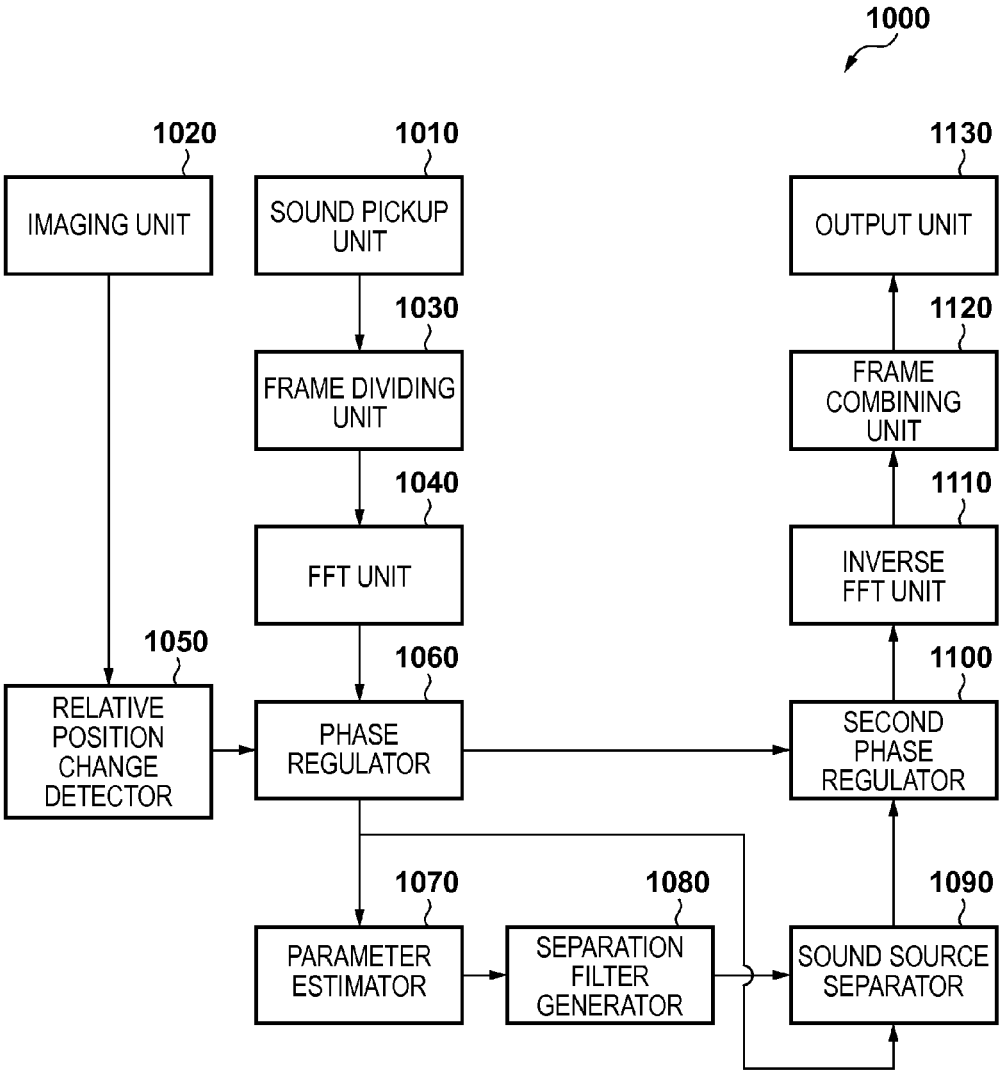
FIG. 1 is a block diagram showing a sound source separation apparatus according to the first embodiment.

Embodiments according to the present invention will be explained in detail below with reference to the accompanying drawings. Note that arrangements disclosed in the following embodiments are merely examples, and the present invention is not limited to these arrangements shown in the drawings.

[First Embodiment]

FIG. 1 is a block diagram of a sound source separation apparatus 1000 according to the first embodiment. The sound source separation apparatus 1000 includes a sound pickup unit 1010, imaging unit 1020, frame dividing unit 1030, FFT unit 1040, relative position change detector 1050, and phase regulator 1060. The apparatus 1000 also includes a parameter estimator 1070, separation filter generator 1080, sound source separator 1090, second phase regulator 1100, inverse FFT unit 1110, frame combining unit 1120, and output unit 1130.

The sound pickup unit 1010 is a microphone array including a plurality of microphones, and picks up sound source signals generated from a plurality of sound sources. The sound pickup unit 1010 performs A/D conversion on the picked-up sound signals of a plurality of channels, and outputs the signals to the frame dividing unit 1030.

The imaging unit 1020 is a camera for capturing a moving image or still image, and outputs the captured image signal to the relative position change detector 1050. In this embodiment, the imaging unit 1020 is, for example, a camera capable of rotating 360°, and can always monitor a sound source position. Also, the positional relationship between the imaging unit 1020 and sound pickup unit 1010 is fixed. That is, when the imaging direction of the imaging unit 1020 changes (a pan-tilt value changes), the direction of the sound pickup unit 1010 also changes.

The frame dividing unit 1030 multiplies an input signal by a window function while shifting a time interval little by little, segments the signal for every predetermined time interval, and outputs the signal as a frame signal to the FFT unit 1040. The FFT unit 1040 performs FFT (Fast Fourier Transform) on each input frame signal. That is, a spectrogram obtained by performing time-frequency conversion on the input signal for each channel is output to the phase regulator 1060.

The relative position change detector 1050 detects the relative positional relationship between the sound pickup unit 1010 and a sound source which changes with time from the input image signal by using, for example, an image recognition technique. For example, the position of the face of an object as a sound source is detected by a face recognition technique in a frame of an image captured by the imaging unit 1020. It is also possible to detect, for example, a change amount between a sound source and the sound pickup unit 1010 by acquiring a change amount (a change amount of a pan-tilt value) in the imaging direction of the imaging unit 1020, which changes with time. The frequency at which the sound source position is detected is desirably the same as a shift amount of the segmentation interval in the frame dividing unit 1030. However, if the frequency of sound source position detection and the shift amount of the segmentation interval are different, it is only necessary to, for example, interpolate or resample the relative positional relationship so that the sound source position detection signal matches the shift amount of the segmentation interval. The detected relative positional relationship between the sound pickup unit 1010 and sound source is output to the phase regulator 1060. The relative positional relationship herein mentioned is, for example, the direction (angle) of a sound source with respect to the sound pickup unit 1010.

Figure 2A:
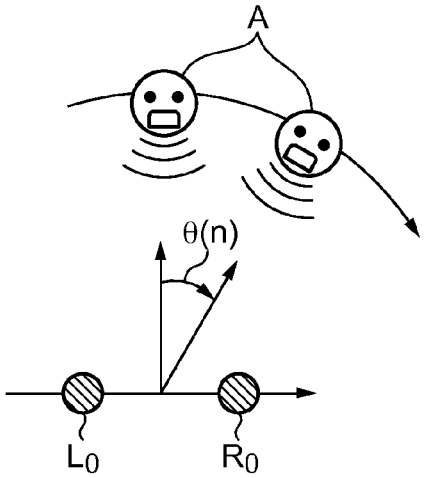
FIGS. 2A and 2B are views for explaining phase regulation.

The phase regulator 1060 performs phase regulation on the input frequency spectrum. An example of this phase regulation will be explained with reference to FIGS. 2A and 2B. The microphones included in the sound pickup unit 110 are two channels $L_0$ and $R_0$. Also, the relative positions of sound source A and the sound pickup unit 1010 changes with time at $\theta(t)$, as shown in FIG. 2A. When the distance to the sound source position is much larger than the spacing between the microphones $L_0$ and $R_0$, a phase difference $P_{diff}(n)$ between signals arriving at the microphones $L_0$ and $R_0$ can be represented as follows:

$$P_{diff}(n) = -\frac{2\cdot\pi\cdot f\cdot d\cdot\sin(\theta(t_n))}{c} \tag{10}$$

where f represents the frequency, d represents the distance between the microphones, c represents the sonic speed, and $t_n$ represents time corresponding to the nth frame.

Figure 2B:
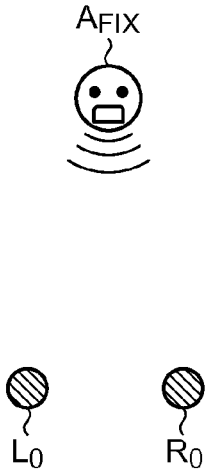

The phase regulator 1060 performs correction of canceling $P_{diff}$ on the signal of the microphone $R_0$ so as to eliminate the phase difference between $L_0$ and $R_0$. A phase-regulated signal $X_{Rcomp}$ is given by:

$$X_{Rcomp}(n,f)=X_R(n,f)*\exp(-i*P_{diff}(n)) \tag{11}$$

where $X_R$ represents the observation signal of the microphone $R_0$. That is, when phase regulation is performed for each frame, the phase difference between the channels does not change with time any longer. As shown in FIG. 2B, therefore, the moving sound source can be handled as sound source $A_{FIX}$ fixed in front of the microphones.

When a plurality of sound sources exist, phase regulation is performed on each sound source. That is, when sound sources A and B exist, a signal obtained by correcting the relative position change of sound source A and a signal obtained by correcting the relative position change of sound source B are generated. The phase-regulated signals are output to the parameter estimator 1070 and sound source separator 1090, and the corrected phase regulation amounts are output to the second phase regulator 1100.

The parameter estimator 1070 uses the EM algorithm on the input phase-regulated signals, thereby estimating the spatial correlation matrix Rj(f), variance vj(n,f), and correlation matrix Rxj(n,f) for each sound source.

Parameter estimation will briefly be explained below. Assume that the sound pickup unit 1010 includes two microphones $L_0$ and $R_0$ placed in a free space, and two sound sources (A and B) exist. Sound source A has a positional relationship $\theta(t_n)$ with the sound pickup unit 1010 at time $t_n$. Sound source B has a positional relationship $\Phi(t_n)$ with the sound pickup unit 1010 at time $t_n$. Letting $X_A$ and $X_B$ be signals which are phase-regulated for the individual sound sources and input from the phase regulator 1060. Sound sources A and B are fixed forward (0°) by phase regulation.

First, parameter estimation is performed by using the phase-regulated signal $X_A$. Since sound source A is fixed in the 0° direction, the spatial correlation matrix $R_A$ is initialized as follows:

$$R_A(f)=h_A(f)*h_A(f)^H+\delta(f) \tag{12}$$

where $h_A$ represents a forward array manifold vector. When the first microphone is a reference point and the sound source direction is Θ, the array manifold vector is:

$$h=[1\exp(i*2\pi fd\ \sin(\Theta))]^T$$

Since sound source A is fixed in the 0° direction, $h_A=[1\ 1]^T$. On the other hand, sound source B is initialized as follows:

$$R'_B(n,f)=h'_B(n,f)*h'_B(n,f)^H+\delta(f) \tag{13}$$

where $h'_B$ is the array manifold vector of sound source B in the state in which sound source A is fixed in the 0° direction, and can be written as follows:

$$h'_B(n,f)=[1\exp(i*2\pi fd\ \sin(\Phi(t_n)-\theta(t_n)))]^T$$

δ(f) takes, for example, the following value:

$$\delta(f)=\alpha*\begin{bmatrix}1 & sinc(2\pi fd/c)\\ sinc(2\pi fd/c) & 1\end{bmatrix}(\alpha<<1) \tag{14}$$

Also, the variance $V_A$ of sound source A and the variance $V_B$ of sound source B are initialized by random values by which, for example, $V_A>0$ and $V_B>0$.

Parameters for sound source A are estimated as follows. This estimation is performed by using the EM algorithm.

In E step, the following calculations are performed:

$$W_A(n,f)=(v_A(n,f)R_A(f))\cdot R_{XA}^{-1}(n,f) \tag{15}$$

$$\hat{c}_A(n,f)=W_A(n,f)\cdot X_A(n,f) \tag{16}$$

$$\hat{R}_{CA}(n,f)=\hat{c}_A(n,f)\cdot\hat{c}_A(n,f)^H+(I-W_A(n,f))\cdot(v_A(n,f)\cdot R_A(f)) \tag{17}$$

where $R_{XA}(n,f)=v_A(n,f)\cdot R_A(f)+v_B(n,f)\cdot R'_B(n,f)$

In M-step, the following calculations are performed:

$$v_A(n,f)=\frac{1}{M}tr\left(R_A^{-1}(f)\cdot\hat{R}_{CA}(n,f)\right) \tag{18}$$

$$R_A(f)=\frac{1}{N}\sum_n\frac{1}{v_A(n,f)}\cdot\hat{R}_{CA}(n,f) \tag{19}$$

where tr( ) represents the sum of the diagonal components of the matrix.

Then, eigenvalue decomposition is performed on the spatial correlation matrix $R_A(f)$. The eigenvalues are $D_{A1}$ and $D_{A2}$ in descending order.

Subsequently, parameter estimation is performed by using the phase-regulated signal $X_B$. Since sound source B is fixed in the 0° direction, sound source B is initialized as follows:

$$R_B(f)=h_B(f)*h_B(f)^H+\delta(f) \tag{20}$$

where $h_B$ represents a forward array manifold vector, and $h_B=[1\ 1]^T$. Sound source A is initialized as follows:

$$R'_A=D_{A1}*h'_A(n,f)\cdot h'_A(n,f)^H+D_{A2}*h'_{A\perp}(n,f)\cdot h'_{A\perp}(n,f)^H \tag{21}$$

The array manifold vector $h'_A$ of sound source A can be written as follows:

$$h'_A(n,f)=[1\exp(i*2\pi fd\ \sin(\theta(t_n)-\Phi(t_n)))]^T$$

$h'_{A\perp}$ represents a vector perpendicular to $h'_A$.

After that, $V_B(n,f)$ and $R_B(f)$ are calculated by using the EM algorithm in the same manner as that for sound source A.

Thus, the parameters are estimated by performing the iterative calculations by using the signals ($X_A$ and $X_B$) having undergone phase regulation which changes from one sound source to another. The number of times of iteration is a predetermined number of times, or the calculations are iterated until the likelihood sufficiently decreases:

The estimated variance vj(n,f), spatial correlation matrix Rj(f), and correlation matrix Rxj(n,f) are output to the separation filter generator 1080. j represents the sound source number, and j=A, B in this embodiment.

The separation filter generator 1080 generates a separation filter for separating the input signal by using the input parameters. For example, from the spatial correlation matrix Rj(f), variance vj(n,f), and correlation matrix Rxj(n,f) of each sound source, the separation filter generator 1080 generates a multi-channel Wiener filter WFj below:

$$WFj(n,f)=(vj(n,f)*Rj(f))\cdot R_{Xj}^{-1}(n,f) \tag{22}$$

The sound source separation unit 1090 applies the separation filter generated by the separation filter generator 1080 to an output signal from the FFT unit 1040:

$$Yj(n,f)=WFj(n,f)\cdot Xj(n,f) \tag{23}$$

The signal Yj(n,f) obtained by filtering is output to the second phase regulator 1100.

The second phase regulator 1100 performs phase regulation on the input separated sound signal so as to cancel the phase regulated by the phase regulator 1060. That is, the signal phase is regulated as if the fixed sound source were moved again. For example, when the phase regulator 1060 has regulated the phase of the $R_0$ signal by γ, the second phase regulator 1100 regulates the phase of the $R_0$ signal by −γ. The phase-regulated signal is output to the inverse FFT unit 1110.

The inverse FFT unit 1110 transforms the input phase-regulated frequency spectrum into a temporal waveform signal by performing IFFT (Inverse Fast Fourier Transform). The transformed temporal waveform signal is output to the frame combining unit 1120. The frame combining unit 1120 combines the input temporal waveform signals of the individual frames by overlapping them, and outputs the signal to the output unit 1130. The output unit 1130 outputs the input separated sound signal to a recording apparatus or the like.

Figure 3:
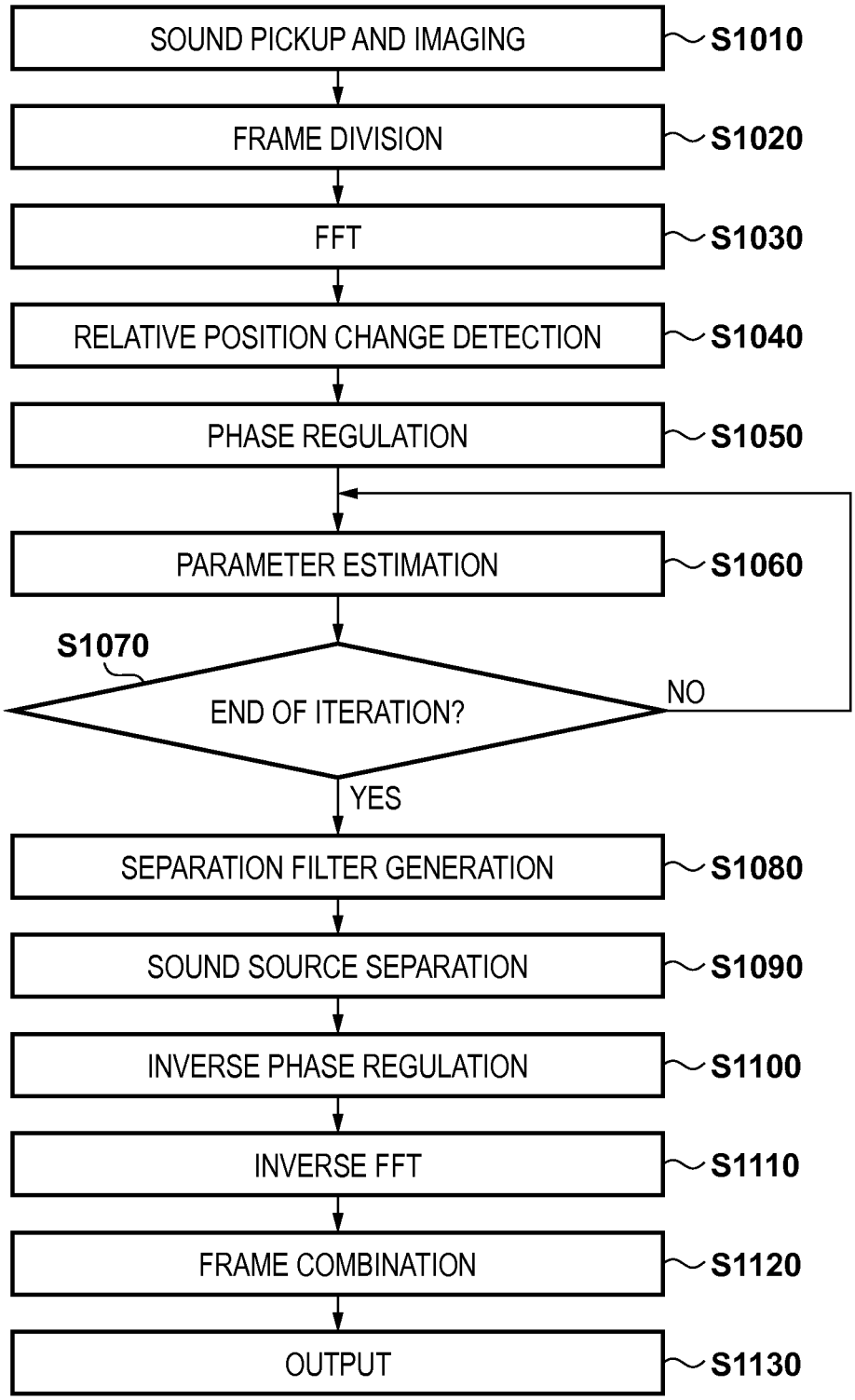
FIG. 3 is a flowchart showing a procedure according to the first embodiment.

Next, the procedure of the signal processing will be explained with reference to FIG. 3. First, the sound pickup unit 1010 and imaging unit 1020 perform sound pickup and imaging (step S1010). The sound pickup unit 1010 outputs the picked-up sound signal to the frame dividing unit 1030, and the imaging unit 1020 outputs the image signal captured around the sound pickup unit 1010 to the relative position change detector 1050.

Then, the frame dividing unit 1030 performs a frame dividing process on the sound signal, and outputs the frame-divided sound signal to the FFT unit 1040 (step S1020). The FFT unit 1040 performs FFT on the frame-divided signal, and outputs the signal having undergone FFT to the phase regulator 1060 (step S1030).

The relative position change detector 1050 detects the temporal relative positional relationship between the sound pickup unit 1010 and sound source, and outputs a concession y indicating the detected temporal relative positional relationship between the sound pickup unit 1010 and sound source to the phase regulator 1060 (step S1040). The phase regulator 1060 regulates the phase of the signal (step S1050). The signal which is phase-regulated for each sound source is output to the parameter estimator 1070 and sound source separator 1090, and the phase regulation amount is output to the second phase regulator 1100.

The parameter estimator 1070 estimates a parameter for generating a sound source separation filter (step S1060). This parameter estimation in step S1060 is repetitively performed until iteration is terminated in iteration termination determination in step S1070. If iteration is terminated, the parameter estimator 1070 outputs the estimated parameter to the separation filter generator 1080. The separation filter generator 1080 generates a separation filter in accordance with the input parameter, and outputs the generated multi-channel Wiener filter to the sound source separator 1090 (step S1080).

Subsequently, the sound source separator 1090 performs a sound source separating process (step S1090). That is, the sound source separator 1090 separates the input phase-regulated signal by applying the multi-channel Wiener filter to the signal. The separated signal is output to the second phase regulator 1100.

The second phase regulator 1100 returns, on the input separated sound signal, the phase regulated by the phase regulator 1060 to the original phase, and outputs the inverse-phase-regulated signal to the inverse FFT unit 1110 (step S1100). The inverse FFT unit 1110 performs inverse FFT (IFFT), and outputs the processing result to the frame combining unit 1120 (step S1110).

The frame combining unit 1120 performs a frame combining process of combining the temporal waveform signals of the individual frames input from the inverse FFT unit 1110, and outputs the combined separated sound temporal waveform signal to the output unit 1130 (step S1120). The output unit 1130 outputs the input separated sound temporal waveform signal (step S1130).

As described above, even when the relative positions of the sound source and sound pickup unit change, sound source separation can stably be performed by detecting the relative positions of the sound source and sound pickup unit, and regulating the phase of an input signal for each sound source.

In this embodiment, the sound pickup unit 1010 has two channels. However, this is so in order to simplify the explanation, and the number of microphones need only be two or more. Also, in this embodiment, the imaging unit 1020 is an omnidirectional camera capable of imaging every direction. However, the imaging unit 1020 may also be an ordinary camera as long as the camera can always monitor an object as a sound source. When an imaging location is a space partitioned by wall surfaces such as an indoor room and the imaging unit is installed in a corner of the room, the camera need only have an angle of view at which the whole room can be imaged, and need not be an omnidirectional camera.

In addition, the sound pickup unit and imaging unit are fixed in this embodiment, but they may also be independently movable. In this case, the apparatus further includes a means for detecting the positional relationship between the sound pickup unit and imaging unit, and corrects the positional relationship based on the detected positional relationship. For example, when the imaging unit is placed on a rotary platform and the sound pickup unit is fixed to a (fixed) pedestal of the rotary platform, the sound source position need only be corrected by using the rotation amount of the rotary platform.

In this embodiment, the relative position change detector 1050 assumes that the utterance of a person is a sound source, and detects the positional relationship between the sound source and sound pickup unit by using the face recognition technique. However, the sound source may also be, for example, a loudspeaker or automobile other than a person. In this case, the relative position change detector 1050 need only perform object recognition on an input image, and detect the positional relationship between the sound source and sound pickup unit.

In this embodiment, a sound signal is input from the sound pickup unit, and a relative position change is detected from an image input from the imaging unit. However, when both the sound signal and the relative positional relationship between the sound pickup device having picked up the signal and the sound source are recorded on a recording medium such as a hard disk, data may also be read out from the recording medium. That is, the apparatus may also include a sound signal input unit instead of the sound pickup unit of this embodiment, and a relative positional relationship input unit instead of the imaging unit, and read out the sound signal and relative positional relationship from the storage device.

In this embodiment, the relative position change detector 1050 includes the imaging unit 1020, and detects the positional relationship between the sound pickup unit 1010 and a sound source from an image acquired from the imaging unit 1020. However, any means can be used as long as the means can detect the relative positional relationship between the sound pickup unit 1010 and a sound source. For example, it is also possible to install a GPS (Global Positioning System) in each of a sound source and the sound pickup unit, and detect the relative position change.

The phase regulator performs processing after the FFT unit in this embodiment, but the phase regulator may also be installed before the FFT unit. In this case, the phase regulator regulates a delay of a signal. Similarly, the order of the second phase regulator and inverse FFT unit may also be reversed.

In this embodiment, the phase regulator performs phase regulation on only the $R_0$ signal. However, phase regulation may also be performed on the $L_0$ signal or on both the $L_0$ and $R_0$ signals. Furthermore, when fixing the position of a sound source, the phase regulator fixes the sound source position in the 0° direction. However, phase regulation may also be performed by fixing the sound source position at another angle.

In this embodiment, it is assumed that the sound pickup unit is a microphone placed in a free space. However, the sound pickup unit may also be placed in an environment including the influence of a housing. In this case, the transmission characteristic containing the influence of the housing in each direction is measured in advance, and calculations are performed by using this transfer characteristic as an array manifold vector. In this case, the phase regulator and second phase regulator regulate not only the phase but also the amplitude.

The array manifold vector is formed by using the first microphone as a reference point in this embodiment, but the reference point can be any point. For example, an intermediate point between the first and second microphones may also be used as the reference point.

[Second Embodiment]

Figure 4:
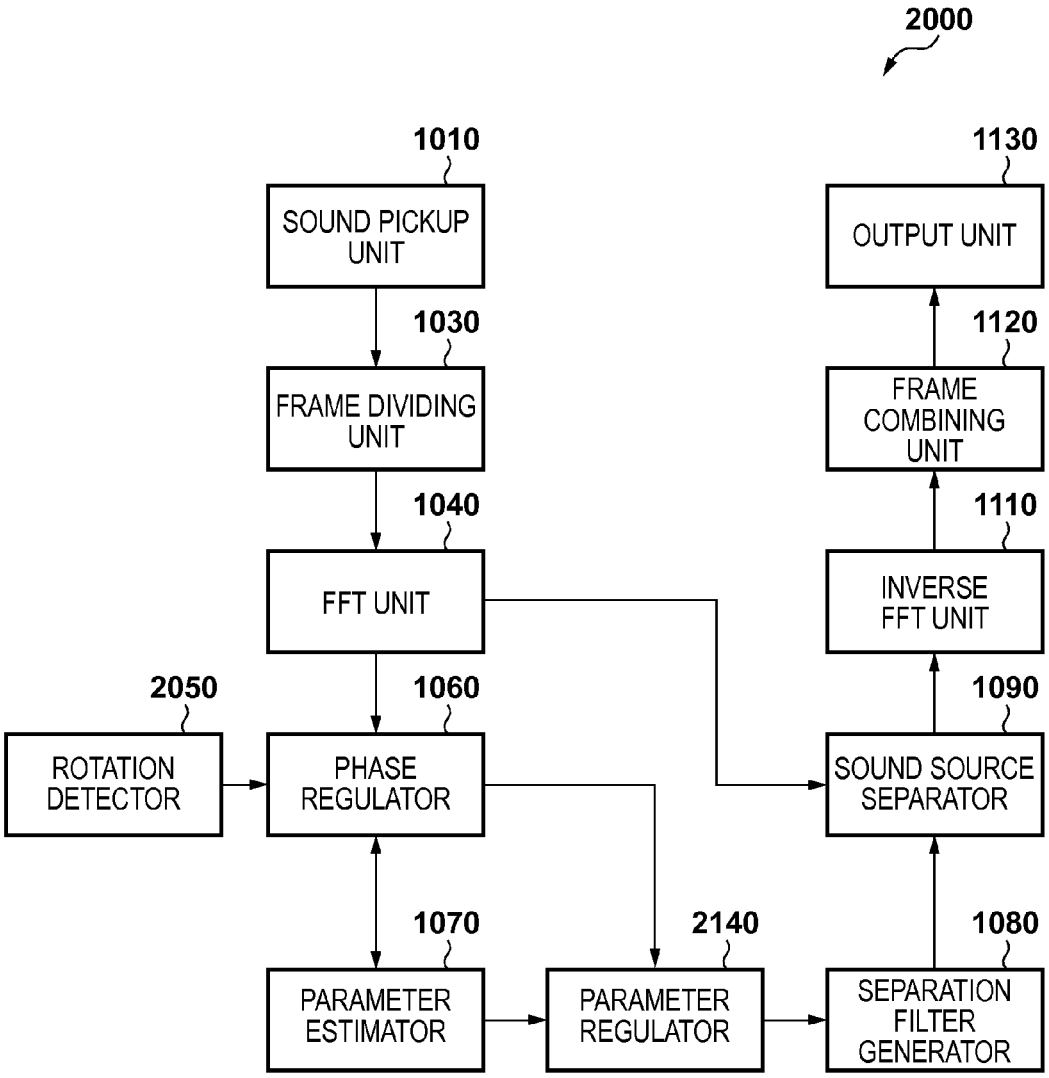
FIG. 4 is a block diagram showing a sound source separation apparatus according to the second embodiment.

FIG. 4 is a block diagram of a sound source separation apparatus 2000 according to the second embodiment. The apparatus 2000 includes a sound pickup unit 1010, frame dividing unit 1030, FFT unit 1040, phase regulator 1060, parameter estimator 1070, separation filter generator 1080, sound source separator 1090, inverse FFT unit 1110, frame combining unit 1120, and output unit 1130. The apparatus 2000 also includes a rotation detector 2050 and parameter regulator 2140.

The sound pickup unit 1010, frame dividing unit 1030, FFT unit 1040, sound source separator 1090, inverse FFT unit 1110, frame combining unit 1120, and output unit 1130 are almost the same as those of the first embodiment explained previously, so an explanation thereof will be omitted.

Figure 5A:
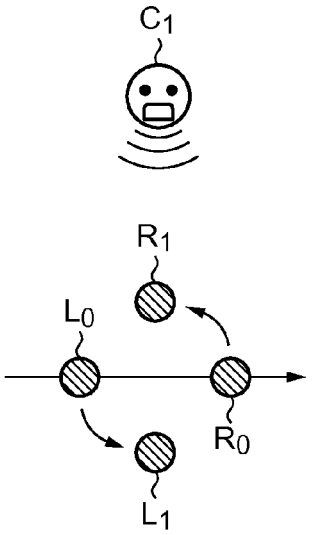
FIGS. 5A and 5B are views for explaining the rotation of a sound pickup unit.
Figure 5B:
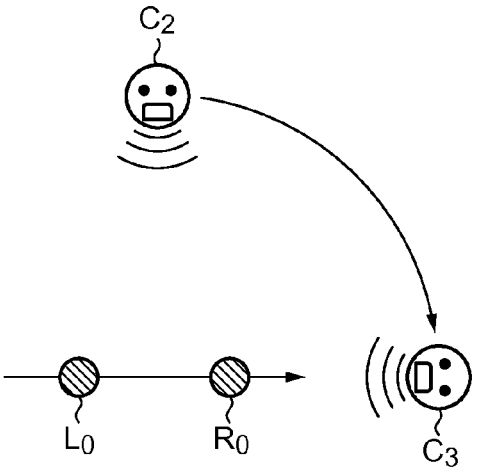

In the second embodiment, it is assumed that a sound source does not move during the sound pickup time, and the sound pickup unit 1010 rotates by user's handling or the like, so the relative positions of the sound pickup unit 1010 and sound source change with time. The rotation of the sound pickup unit 1010 means the rotation of a microphone array caused by a panning, tilting, or rolling operation of the sound pickup unit 1010. For example, when the microphone array as the sound pickup unit rotates from a state ($L_0$, $R_0$) to a state ($L_1$, $R_1$) with respect to a sound source $C_1$ whose position is fixed as shown in FIG. 5A, the sound source apparently moves from $C_2$ to $C_3$ when viewed from the microphone array as shown in FIG. 5B.

The rotation detector 2050 is, for example, an acceleration sensor, and detects the rotation of the sound pickup unit 1010 during the sound pickup time. The rotation detector 2050 outputs the detected rotation amount as, for example, angle information to the phase regulator 1060.

The phase regulator 1060 performs phase regulation based on the input rotation amount of the sound pickup unit 1010 and the sound source direction input from the parameter estimator 1070. As the sound source direction, an arbitrary value is given as an initial value for each sound source for only the first time. For example, letting $\alpha$ be the sound source direction and $\beta(n)$ be the rotation amount of the sound pickup unit 1010, the phase difference between the channels is as follows:

$$P_{diff}(n) = \frac{2\pi f d \sin(\alpha - \beta(n))}{c} \tag{24}$$

The phase regulator 1060 performs phase regulation on this inter-channel phase difference, outputs the phase-regulated signal to the parameter estimator 1070, and outputs the phase regulation amount to the parameter regulator 2140. The parameter estimator 1070 performs parameter estimation on the phase-regulated signal.

The parameter estimation method is almost the same as that of the first embodiment. In the second embodiment, however, main component analysis is further performed on an estimated spatial correlation matrix Rj(f), and a sound source direction $\gamma'$ is estimated. Letting $\gamma$ be the direction in which the sound source is fixed by the phase regulator 1060, $\alpha+\gamma'-\gamma$ is output as the sound source direction to the phase regulator 1060. An estimated variance vj(f,n) and the estimated spatial correlation matrix Rj(f) are output to the parameter regulator 2140.

The parameter regulator 2140 calculates a spatial correction matrix $Rj_{new}(n,f)$ which changes with time by using the input spatial correlation matrix Rj(f) and phase regulation amount. For example, letting $\eta(n,f)$ be the phase regulation amount of the R channel, parameters to be used in filter generation are regulated by:

$$Rj_{new}(n, f) = \begin{bmatrix} 1 & 0 \\ 0 & \exp(-\eta(n, f)) \end{bmatrix} \cdot Rj(f) \cdot \begin{bmatrix} 1 & 0 \\ 0 & \exp(\eta(n, f)) \end{bmatrix} \tag{25}$$

The parameter estimator 2140 outputs the regulated spatial correlation matrix $Rj_{new}(n,f)$ and variance vj(n,f) to the separation filter generator 1080. Upon receiving these parameters, the separation filter generator 1080 generates a separation filter as follows:

$$WFj(n, f) = vj(n, f) \cdot Rj_{new}(n, f) \cdot \left( \sum_j vj(n, f) \cdot Rj_{new}(n, f) \right)^{-1} \tag{26}$$

Then, the separation filter generator 1080 outputs the generated filter to the sound source separator 1090.

Figure 6:
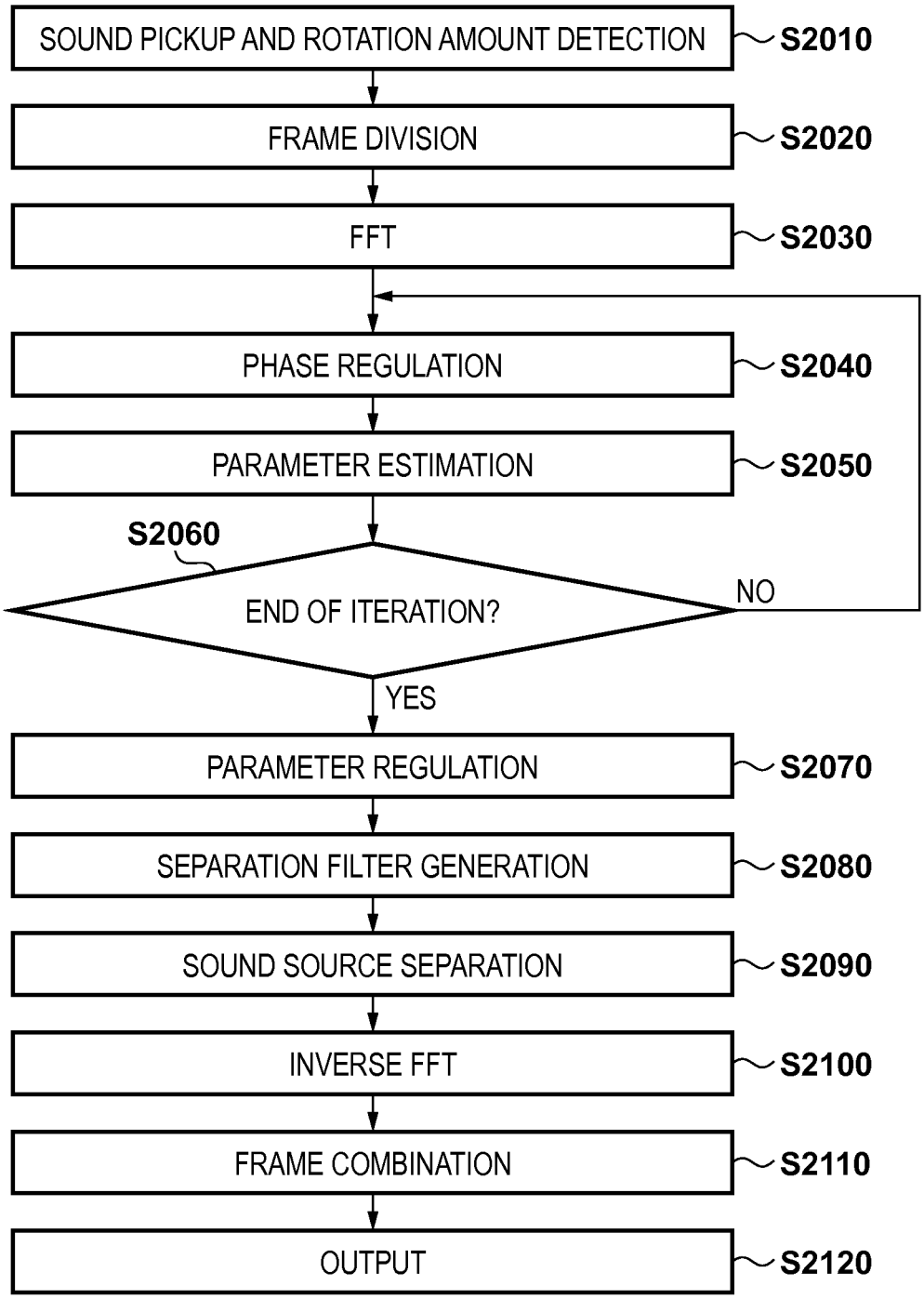
FIG. 6 is a flowchart showing a procedure according to the second embodiment.

Next, a signal processing procedure according to the second embodiment will be explained with reference to FIG. 6. First, the sound pickup unit 1010 performs a sound pickup process, and the rotation detector 2050 performs a process of detecting the rotation amount of the sound pickup unit 1010 (step S2010). The sound pickup unit 1010 outputs the picked-up sound signal to the frame dividing unit 1030. The rotation detector 2050 outputs information indicating the detected rotation amount of the sound pickup unit 1010 to the phase regulator 1060. Subsequent frame division (step S2020) and FFT (step S2030) are almost the same as those of the first embodiment, so an explanation thereof will be omitted.

The phase regulator 1060 performs a phase regulating process (step S2040). That is, the phase regulator 1060 calculates a phase regulation amount of the input signal from the sound source position input from the parameter estimator 1070, and the rotation amount of the sound pickup unit 1010, and performs a phase regulating process on the signal input from the FFT unit 1040. Then, the phase regulator 1060 outputs the phase-regulated signal to the parameter estimator 1070.

Subsequently, the parameter estimator 1070 estimates a sound source separation parameter (step S2050). The parameter estimator 1070 then determines whether to terminate iteration (step S2060). If iteration is not to be terminated, the parameter estimator 1070 outputs the estimated sound source position to the phase regulator 1060, and phase regulation (step S2040) and parameter estimation (step S2050) are performed again. If it is determined that iteration is to be terminated, the phase regulator 1060 outputs the phase regulation amount to the parameter regulator 2140. Also, the parameter estimator 1070 outputs the estimated parameter to the parameter regulator 2140.

The parameter regulator 2140 regulates the parameter (step S2070). That is, the parameter regulator 2140 regulates the spatial correlation matrix Rj(f) as the sound source separation parameter estimated by using the input phase regulation amount. The regulated spatial correlation matrix $Rj_{new}(n,f)$ and variance vj(n,f) are output to the separation filter generator 1080.

Subsequent sound source separation filter generation (S2080), sound source separating process (step S2090), inverse FFT (step S2100, frame combining process (step S2110), and output (step S2120) are almost the same as those of the first embodiment, so an explanation thereof will be omitted.

As described above, even when the relative positions of the sound source and sound pickup unit change, sound source separation can stably be performed by detecting the relative positions of the sound source and sound pickup unit. That is, a sound source separation filter can stably be generated by estimating a parameter from a phase-regulated signal, and performing correction by taking account of a phase amount obtained by further regulating the estimated parameter.

The rotation detector 2050 is an acceleration sensor in the second embodiment, but the rotation detector 2050 need only be a device capable of detecting a rotation amount, and may also be a gyro sensor, an angular velocity sensor, or a magnetic sensor for sensing azimuth. It is also possible to detect a rotational angle from an image by using an imaging unit in the same manner as in the first embodiment. Furthermore, when the sound pickup unit is fixed on a rotary platform or the like, the rotational angle of this rotary platform may also be detected.

[Third Embodiment]

Figure 7:
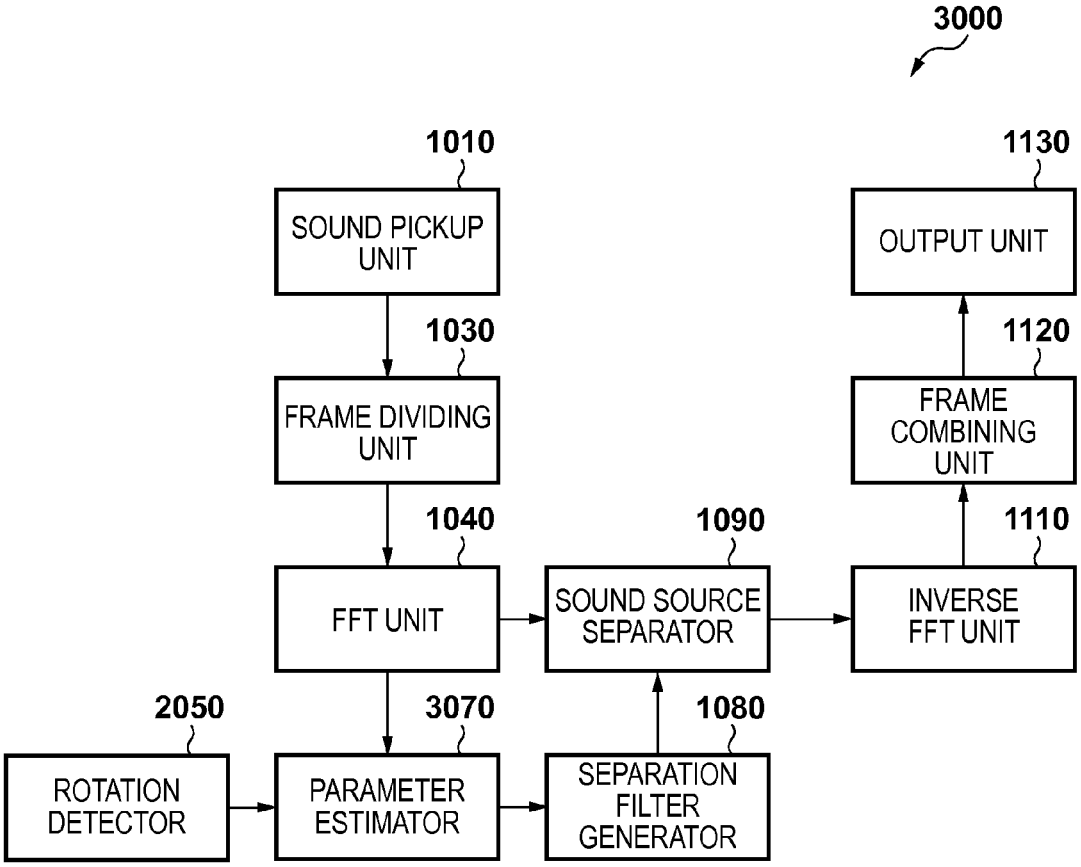
FIG. 7 is a block diagram showing a sound source separation apparatus according to the third embodiment.

FIG. 7 is a block diagram showing a sound source separation apparatus 3000 according to the third embodiment. The apparatus 3000 includes a sound pickup unit 1010, frame dividing unit 1030, FFT unit 1040, rotation detector 2050, parameter estimator 3070, separation filter generator 1080, sound source separator 1090, inverse FFT unit 1110, frame combining unit 1120, and output unit 1130.

Blocks other than the parameter estimator 3070 are almost the same as those of the first embodiment explained previously, so an explanation thereof will be omitted. In the third embodiment, a sound source does not move during the sound pickup time as in the second embodiment.

The parameter estimator 3070 performs parameter estimation by using information indicating the rotation amount of the sound pickup unit 1010 and input from the rotation detector 2050, and a signal input from the FFT unit 1040. In the EM algorithm for estimation, (3) to (6) in E step and M step are calculated in the same manner as in the conventional method.

A method of calculating a spatial correlation matrix will be described below. A spatial correlation matrix Rj(n,f) which changes with time is calculated in accordance with:

$$Rj(n, f) = \frac{1}{vj(n, f)} \hat{R}cj(n, f) \tag{27}$$

A sound source direction θj(n,f) can be calculated for each time by performing eigenvalue decomposition (main component analysis) on the calculated Rj(n,f). More specifically, the sound source direction is calculated from a phase difference between elements of an eigenvector corresponding to the largest one of eigenvalues calculated by eigenvalue decomposition. Then, the influence of the rotation of the sound pickup unit 1010, which is input from the rotation detector 2050, is removed from the calculated sound source direction θj(n,f). For example, letting ω(n) be the rotation amount of the sound pickup unit 1010, a relative sound source position change amount is −ω(n). That is, sound source position $\theta j_{comp}(n,f)=\theta j(n,f)+\omega(n)$ is the sound source direction when there is no rotation. Subsequently, the weighted average of the calculated $\theta j_{comp}(n,f)$ in the time direction is calculated as follows:

$$\theta j_{ave}(f) = \frac{\sum_n \theta j_{comp}(n, f) \cdot vj(n, f)}{\sum_n vj(n, f)} \tag{28}$$

In this case, the weighted average of the variance vj(n,j) is calculated because a wrong direction is highly likely calculated as the sound source direction $\theta j_{comp}(n,f)$ if vj(n,f) decreases (the signal amplitude decreases).

An apparent movement of the sound source caused by the rotation is added to the calculated direction $\theta j_{ave}(f)$ again, and the sound source direction:

$$\hat{\theta}j(n,f)$$

is calculated as follows:

$$\hat{\theta}j(n,f)=\theta j_{ini}(f)-\omega(n) \tag{29}$$

Subsequently, assuming that the eigenvalues calculated by eigenvalue decomposition of Rj(n,f) are $D_1(n,f)$ and $D_2(n,f)$ in descending order, a ratio gj(f) is calculated as follows:

$$gj(f) = \frac{1}{N} \sum_n \frac{D_2(n, f)}{D_1(n, f)} \tag{30}$$

Then, the spatial correlation matrix Rj(n,f) is updated from:

$$\hat{\theta}j(n,f)$$

and gj(f) as follows:

$$\hat{R}j(n,f)=h(\hat{\theta}j(n,f))\cdot h(\hat{\theta}j(n,f))^H+gj(f)\cdot h_\perp(\hat{\theta}j(n,f))\cdot h_\perp(\hat{\theta}j(n,f))^H \tag{31}$$

$\hat{R}j(n,f)$ represents the updated spatial correlation matrix, and $$h(\hat{\theta}j(n,f))$$

represents an array manifold vector with respect to a direction:

$$\hat{\theta}j(n,f)$$

Also, the spatial correlation matrix is an Helmitian matrix, so the eigenvectors are perpendicular to each other. Therefore, $$h_{\perp}(\hat{\theta}j(n,f))$$

is a vector perpendicular to $$h(\hat{\theta}j(n,f))$$

and has the following relationship:

$$h_{\perp}(\hat{\theta}j(n,f))=h(\hat{\theta}j(n,f)+\pi)$$

As described above, the parameter estimator 3070 calculates the spatial correlation matrix as a parameter which changes with time. Then, the parameter estimator 3070 outputs the calculated spatial correlation matrix:

$$\hat{R}j(n,f)$$

and the variance vj(n,f) to the separation filter generator 1080.

Figure 8:
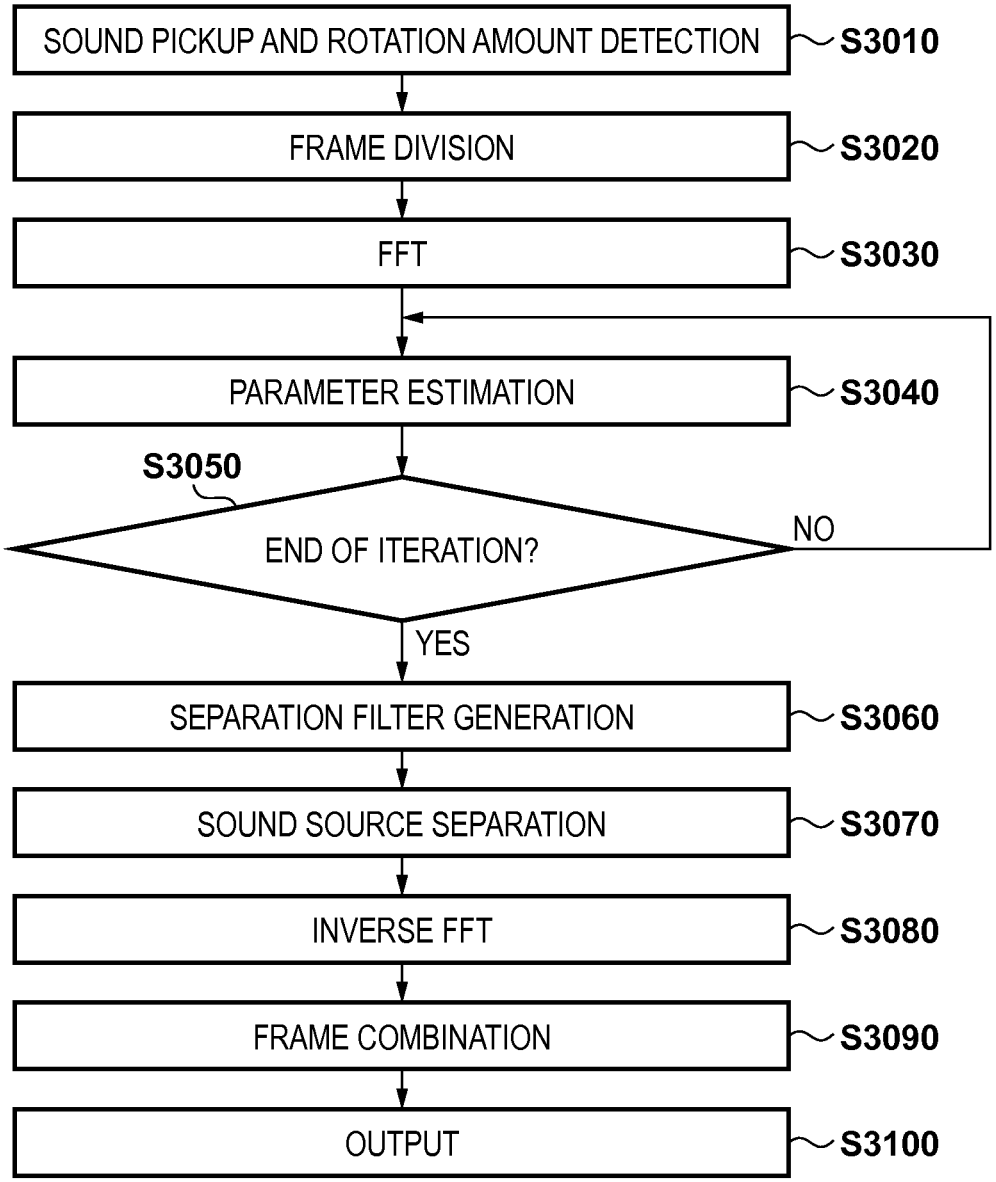
FIG. 8 is a flowchart showing a procedure according to the third embodiment.

Next, a signal processing procedure according to the third embodiment will be explained with reference to FIG. 8. Processes from sound pickup and rotation amount detection (step S3010) to FFT (step S3030) and processes from separation filter generation (step S3060) to output (step S3100) are almost the same as those of the above-described second embodiment, so an explanation thereof will be omitted.

The parameter estimator 3070 performs a parameter estimating process (step S3040), and iterates the parameter estimating process until it is determined that iteration is terminated in subsequent iteration termination determination (step S3050). If it is determined that iteration is terminated, the parameter estimator 3070 outputs the parameter estimated in that stage to the separation filter generator 1080.

The separation filter generator 1080 generates a separation filter, and outputs the generated separation filter to the sound source separator 1090 (step S3060).

As described above, even when the relative positions of the sound source and sound pickup unit change, sound source separation can stably be performed by detecting the relative positions of the sound source and sound pickup unit, and using a parameter estimating method taking account of the sound source position.

In the third embodiment, the parameter estimator calculates the sound source direction θj(n) in order to estimate the spatial correlation matrix:

$$\hat{R}j(n,f)$$

However, it is also possible to perform phase regulation so as to cancel the rotation of the sound pickup unit 1010 for the first main component, without calculating the sound source direction, and obtain the average value.

In addition, the weighted average of the variance vj(n,f) is calculated when calculating the position of a sound source at the start of sound pickup. However, it is also possible to simply calculate the average value. In this embodiment, the sound source direction:

$$\hat{\theta}j(n,f)$$

is independently calculated for the frequency. However, it is unlikely that the same sound source has different directions. Therefore, it is also possible to use:

$$\hat{\theta}j(n)$$

as a frequency-independent parameter by, for example, calculating the average in the frequency direction.

[Other Embodiments]

The embodiments have been described in detail above. However, the present invention can take an embodiment in the form of, for example, a system, apparatus, method, control program, or recording medium (storage medium), provided that the embodiment has a sound pickup means for picking up sound signals of a plurality of channels. More specifically, the present invention is applicable to a system including a plurality of devices (for example, a host computer, interface device, imaging device, and web application), or to an apparatus including one device.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-108442, filed May 26, 2014, which is hereby incorporated by reference herein in its entirety.

What is claimed is:

1. A sound source separation apparatus comprising:

a sound pickup unit configured to pick up sound signals of a plurality of channels;

a detector configured to detect relative positions, corresponding to each of a plurality of frames, between a sound source and the sound pickup unit;

a phase regulator configured to perform phase regulation of the sound signals of a first channel among the plurality of channels in each of the plurality of frames, using the relative positions corresponding to each of the plurality of frames, such that a phase difference between the sound signals of the first channel and the sound signals of a second channel among the plurality of channels is a predetermined value in each of the plurality of frames;

one or more processors;

a memory coupled to the one or more processors, the memory having stored thereon instructions which, when executed by the one or more processors cause the sound source separation apparatus to:

divide the sound signals of the plurality of channels into the plurality of frames, each of the plurality of frames having a predetermined time period, and estimate a sound source separation parameter using the regulated sound signals; and a sound source separator configured to, for each of the plurality of frames, perform sound source separation for separating sound signals generated by the sound source from the sound signals by using a separation filter based on the sound source separation parameter.

2. The sound source separation apparatus according to claim 1, further comprising a second phase regulator configured to return a phase of output signals from the sound source separator, which phase is regulated by the phase regulator, to the original phase.

3. The sound source separation apparatus according to claim 1, wherein the sound source separator comprises a parameter regulator configured to correct the sound source separation parameter from a spatial correlation matrix as the sound source separation parameter and a phase regulation amount regulated by the phase regulator, and the sound source separator generates a separation filter from the corrected sound source separation parameter, and performs sound source separation.

4. The sound source separation apparatus according to claim 1, wherein the phase regulator performs phase regulation by an amount which changes from one sound source to another, and the memory includes further instructions which, when executed by the one or more processors, cause the sound source separation apparatus to perform parameter estimation from the sound signals whose phase is regulated for each sound source.

5. The sound source separation apparatus according to claim 1, wherein the phase regulator regulates a delay of the sound signals.

6. The sound source separation apparatus according to claim 1, wherein the phase regulator regulates a phase of the sound signals having undergone time-frequency conversion.

7. The sound source separation apparatus according to claim 1, wherein the memory includes further instructions which, when executed by the one or more processors, cause the sound source separation apparatus to calculate a spatial correlation matrix for each time-frequency, perform eigenvalue decomposition on the spatial correlation matrix calculated for each time-frequency, calculate a sound source direction from an eigenvector corresponding to a largest eigenvalue of calculated eigenvalues, and update a spatial correlation matrix from the calculated sound source direction, the relative position change amount detected by the detector, and the eigenvalue of the spatial correlation matrix.

8. The sound source separation apparatus according to claim 1, wherein the separation filter is a multi-channel Wiener filter.

9. The sound source separation apparatus according to claim 1, wherein the detector detects at least one of rotation of the sound pickup unit, movement of the sound pickup unit, and movement of the sound source.

10. The sound source separation apparatus according to claim 1, wherein the phase regulator performs the phase regulation of each of the plurality of frames of the first channel among the plurality of channels using the relative positions corresponding to each of the plurality of frames, so as to become the phase difference between the sound signals of the first channel and the sound signals of the second channel among the plurality of channels to zero.

11. The sound source separation apparatus according to claim 1, wherein the memory includes further instructions which, when executed by the one or more processors, cause the sound source separation apparatus to estimate the sound source separation parameter including a variance and a spatial correlation matrix.

12. A method of controlling a sound source separation apparatus which comprises a sound pickup unit configured to pick up sound signals of a plurality of channels, and performs sound source separation from the sound signals obtained by the sound pickup unit, comprising:

dividing the sound signals of the plurality of channels into a plurality of frames each having a predetermined time period;

detecting relative positions, corresponding to each of the plurality of frames, between a sound source and the sound pickup unit;

performing phase regulation of the sound signals of a first channel among the plurality of channels in each of the plurality of frames, using the relation positions corresponding to each of the plurality of frames, such that a phase difference between the sound signals of the first channel and the sound signals of a second channel among the plurality of channels is a predetermined value in each of the plurality of frames;

estimating a sound source separation parameter using the regulated sound signals; and performing, for each of the plurality of frames, sound source separation for separating sound signals generated by the sound source from the sound signals by using a separation filter based on the sound source separation parameter.

13. A non-transitory computer-readable storage medium storing a program for causing a computer, which comprises a sound pickup unit configured to pick up sound signals of a plurality of channels and which performs sound source separation from the sound signals obtained by the sound pickup unit, to execute steps comprising:

dividing the sound signals of the plurality of channels into a plurality of frames each having a predetermined time period;

detecting relative positions, corresponding to each of the plurality of frames, between a sound source and the sound pickup unit;

performing phase regulation of the sound signals of a first channel among the plurality of channels in each of the plurality of frames, using the relation positions corresponding to each of the plurality of frames, such that a phase difference between the sound signals of the first channel and the sound signals of a second channel among the plurality of channels is a predetermined value in each of the plurality of frames;

estimating a sound source separation parameter using the regulated sound signals; and performing, for each of the plurality of frames, sound source separation for separating sound signals generated by the sound source from the sound signals by using a separation filter based on the sound source separation parameter.

* * * * *